US005101879A

United States Patent [19]

Beck et al.

[11] Patent Number: 5,101,879

[45] Date of Patent: Apr. 7, 1992

[54] METHOD AND APPARATUSES FOR APPLYING MOLTEN HARD MATERIAL TO TEETH OF CUTTING TOOLS

[75] Inventors: Ernst Beck, Maselheim; Peter Lenard, Biberach an der Riss; Johann Bayer, Hochdorf, all of Fed. Rep. of Germany

[73] Assignee: Vollmer Werke Maschinenfabrik GmbH, Fed. Rep. of Germany

[21] Appl. No.: 454,286

[22] Filed: Dec. 21, 1989

[30] Foreign Application Priority Data

Dec. 23, 1988 [DE] Fed. Rep. of Germany ..... 3843647

[51] Int. Cl.[5] ..... B22D 23/06; B22D 19/08

[52] U.S. Cl. ..... 164/98; 164/66.1; 164/332; 164/80

[58] Field of Search ..... 164/98, 91, 76.1, 66.1, 164/48, 496, 250.1, 332, 105, 80

[56] References Cited

U.S. PATENT DOCUMENTS

| | | | |
|---|---|---|---|
| Re. 31,767 | 12/1984 | Brooks | 164/46 |
| 2,277,571 | 3/1942 | Wagner | 164/105 |
| 2,688,168 | 9/1954 | Hurt | 164/105 |
| 3,570,449 | 3/1971 | Blecho | 164/76.1 |
| 3,889,741 | 6/1975 | Stier | 164/332 |
| 4,033,402 | 7/1977 | Eberle | 164/332 |
| 4,394,879 | 7/1983 | Reynolds | 164/76.1 |
| 4,632,170 | 12/1986 | Pöhl | 164/250.1 |
| 4,695,329 | 9/1987 | Hayashi | 164/76.1 |
| 4,794,979 | 1/1989 | Gassner | 164/66.1 |
| 4,811,782 | 3/1989 | Sola | 164/66.1 |

FOREIGN PATENT DOCUMENTS

| | | | |
|---|---|---|---|
| 1558378 | 4/1970 | Fed. Rep. of Germany . | |
| 2330803 | 1/1975 | Fed. Rep. of Germany | 164/98 |
| 42811 | 11/1928 | Italy | 164/250.1 |

*Primary Examiner*—Richard K. Seidel
*Assistant Examiner*—Rex E. Pelto
*Attorney, Agent, or Firm*—Wallenstein, Wagner & Hattis, Ltd.

[57] ABSTRACT

Around a tooth, a molding cavity is formed which is closed at the tooth face and tooth flanks and in which the mold material forms a dome due to its surface tension. Said dome is flattened prior to the solidification of the material for approximation to the intended profile of the tooth back by exerting a pressure on the dome which pressure is moved progressively in the direction towards the tooth tip. When the hard material is melted with a gas or plasma jet the latter can be moved after the melting of the hard material in the direction towards the tooth tip over the dome. The gas jet is used to smooth the material after a first heating torch is used to melt the material.

1 Claim, 4 Drawing Sheets

METHOD AND APPARATUSES FOR APPLYING MOLTEN HARD MATERIAL TO TEETH OF CUTTING TOOLS

BACKGROUND OF THE INVENTION

The invention relates to a method for applying molten hard material to teeth of cutting tools, in particular to saw blades. In one method heretofore practiced, a tooth mold cavity is formed at the sides of the tooth. The cavity is closed at the tooth face when a molten material is formed in the mold cavity, its surface tension forms a dome which, prior to the solidification of the material is flattened by applying a pressure to form a tooth covering the back of the tooth having substantially the same profile as the tooth back. .

The hardened material can be placed in a pulverulent form into the mold cavity and then melted for example by electroinductive energy. Thereafter, in one form of the invention a ram having its lower side bevelled corresponding to the intended tooth back shape is pressed from above into the mold cavity to flatten the dome of the melted material. The direction of movement of the ram is vertical whilst the saw blade is clamped in such a manner that the cutting direction of the tooth received in the mold cavity is horizontal. The movement direction of the ram thus extends at a right-angle to the cutting direction of the respective tooth. When the ram is lowered and presses flat the dome formed by the molten material the molten material is laterally displaced. To ensure that the material also moves into the region in which the tooth tip is to be formed it is necessary for a considerable excess of molten material to have been present in the mold cavity before lowering of the ram. After solidification of the hard material this excess must be worked off by particularly time-consuming grinding of the tooth face, the tooth flanks and the tooth back.

SUMMARY OF THE INVENTION

The invention is based on the problem of reducing the material excess necessary on applying molten hard material to the teeth of cutting tools without increasing the risk of individual tooth tips being incompletely formed because of a lack of material.

Proceeding from a method of the type above described, this problem is solved in that the pressure necessary for flattening the dome is applied to the dome progressively in the direction towards the tooth tip. As a result, the proportion of the molten material which originally formed the dome is used to a very great extent or even completely for forming the tooth tip. Consequently, thereafter, it is only necessary to grind away a small amount of material. This saves material and reduces the time necessary for grinding each individual tooth.

In one form of the invention, a ram like that previously used is lowered into the mold and as the dome is flattened by the ram, the ram is moved towards the tooth tip.

The method according to the invention may however also be carried out without ram. If the hard material is melted with a gas or plasma jet said gas or plasma jet directed against the dome according to one form of the invention after the melting of the hard material the jet is moved over the dome in the direction towards the tooth tip.

Irrespective of the manner in which the hard material has been melted, according to a further embodiment of the method according to the invention the jet can be directed along the tooth back towards the tooth tip to move and flatten the dome of molten material and move it over the tooth tip.

The two procedures of the method according to the invention in which the operation is carried out without ram have the particular advantage that even with teeth unfavourably shaped in this respect it is possible to eliminate with certainty any air inclusion in the mold cavity and its process can be carried out more quickly.

Suitable for example for carrying out the method according to the invention is the described known apparatus with molding jaws which are adapted to be applied against a tooth and a ram which is reciprocal along a ram axis. According to the invention the ram axis is rearwardly inclined with respect to the tooth and encloses with the cutting direction of the latter an angle of at most 70°, preferably 50° to 60°.

If however the operation is to be carried out without a ram, an apparatus suffices having molding jaws which are adapted to be applied against a tooth and a gas or plasma torch of which the mouth is directed onto the tooth back. According to the invention the gas or plasma torch, when the molding jaws are closed, is movable by means of its own drive in such a manner that its mouth travels in the direction towards the tooth tip.

Alternatively, an apparatus having molding jaws adapted to be applied to a tooth can have associated therewith at least one nozzle which is connected to a conduit for gas, in particular protective gas, and at least approximately directed in the cutting direction of the tooth towards the tooth tip.

THE DRAWINGS

Examples of embodiment of the invention will be described in further detail hereinafter with the aid of schematic drawings, wherein.

Figure 2:
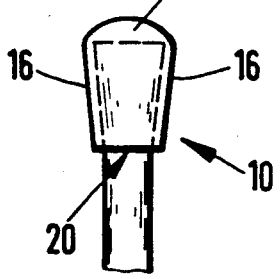
FIG. 2 is the front view of the saw tooth in the direction of the arrow II in FIG. 1.
Figure 1:
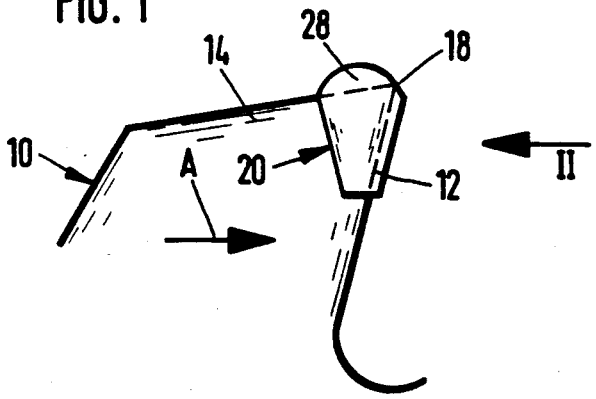
FIG. 1 is a side elevation of a saw tooth with hard material applied in molten state and solidified in dome shape.
Figure 4:
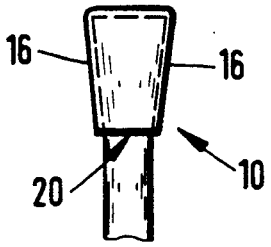
FIG. 4 is the front view in the direction of the arrow IV—IV in FIG. 3.
Figure 3:
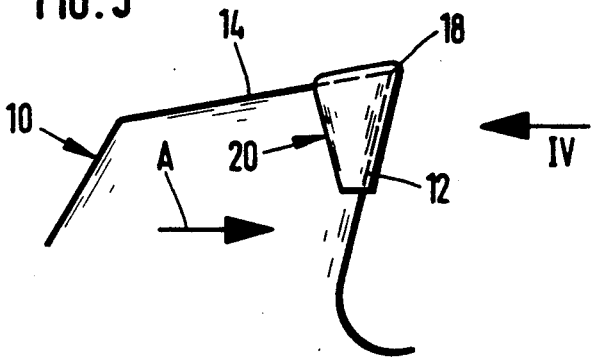
FIG. 3 is a side elevation of a saw tooth with hard enable material after it has been applied in a molten state and then flattened.
Figure 5:
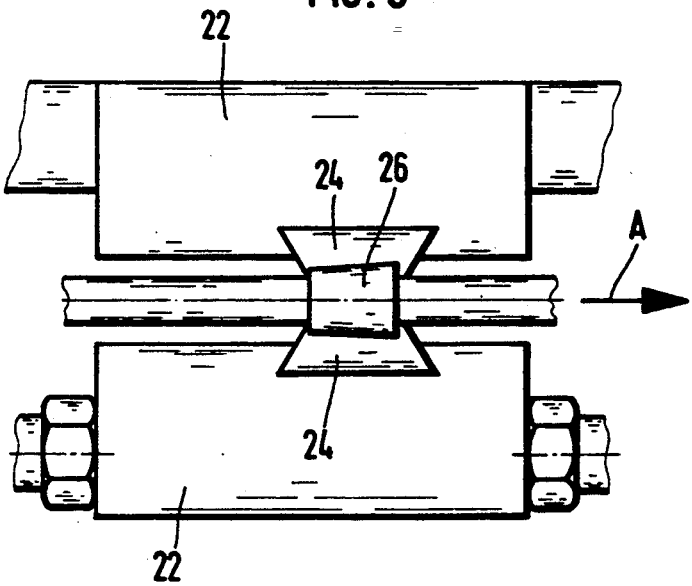
FIG. 5 is the plan view of parts of an apparatus for applying a molten hardenable material to the teeth of a saw blade.

In FIGS. 1 to 4 a tooth 10 of a saw blade is shown, said blade being possibly for a circular saw, a band saw or a gate saw. The arrows A in FIGS. 1, 3 and 5 denote the cutting direction in which the tooth 10 moves during sawing. The tooth 10 has a tooth face 12, a tooth back 14 and two tooth flanks 16. The tooth face 12 intersects the tooth back 14 in an upper edge which is referred to as tooth tip 18.

The purpose of the apparatuses illustrated is to apply to the tooth 10 a layer of hard material 20 which is a thermoplastic material which for this purpose the material 20 is melted. At the same time the tooth 10 heated at the tooth tip 18 so that the material 20 is alloyed on. In the molten state the surface tension of the hard material 20 tends to reduce the material surface to a minimum, i.e. form a sphere. To prevent this as far as possible from the start each of the apparatuses illustrated comprises a pair of mold carriers 22 each bearing a molding jaw 24 adapted to be applied to the tooth 10.

The two molding jaws 24 form a molding cavity 26 which receives the molten hard material 20 and forces it in the region of the tooth face 12 and the tooth flank 16 to assume the shape thereof. However, in the region of the tooth back 14 the molten material 20 is free and therefore forms there a spherical bulge or dome 28. The latter is flattened with the steps described hereinafter so that on solidification the hard material 20 assumes the shape which can be seen from FIGS. 3 and 4 and which apart from slight grinding allowances at the tooth face 12, the tooth back 14 and the two tooth flanks 16 coincides with the final form of the ground tooth 10.

The apparatus shown in various modifications for applying the hard material 20 to a respective tooth 10 of a saw blade has a frame 30 on which the saw blade is mounted. By means of a device of conventional design, not illustrated, the saw blade can be moved oppositely to the cutting direction A in such a manner that in each case a tooth 10 moves between the molding jaws 24. By a means of conventional apparatus, likewise not illustrated, said jaws are then applied sealingly against the tooth 10.

Secured to the frame 30 is a column 32 on which a horizontal guide 34 is mounted in vertically adjustable manner. Guided on the guide 34 is a carriage 36 which is horizontally displaceable by means of a drive 38, for example a stepping motor and a threaded spindle 40. A rotary body 42 is mounted rotatably adjustably about a horizontal axis B on the carriage 36 and adapted to be locked in a selected angular position by means of a toggle 44.

In the rotary body 42 a plasma torch 46 is adjustably mounted in the direction of its own axis C. The plasma torch 46 has a mouth 48 arranged a slight distance above the mold cavity 26. Between said mouth and the mold cavity 26 by means of a feed means 50 likewise of known design a material rod 52 is supplied. In operation, the hard material 20 is melted from the free end of the material rod 52 by means of a plasma jet directed out of the mouth 48 onto the mold cavity 26 so that said material drips into the mold cavity 26 and fills the latter.

Figure 6:
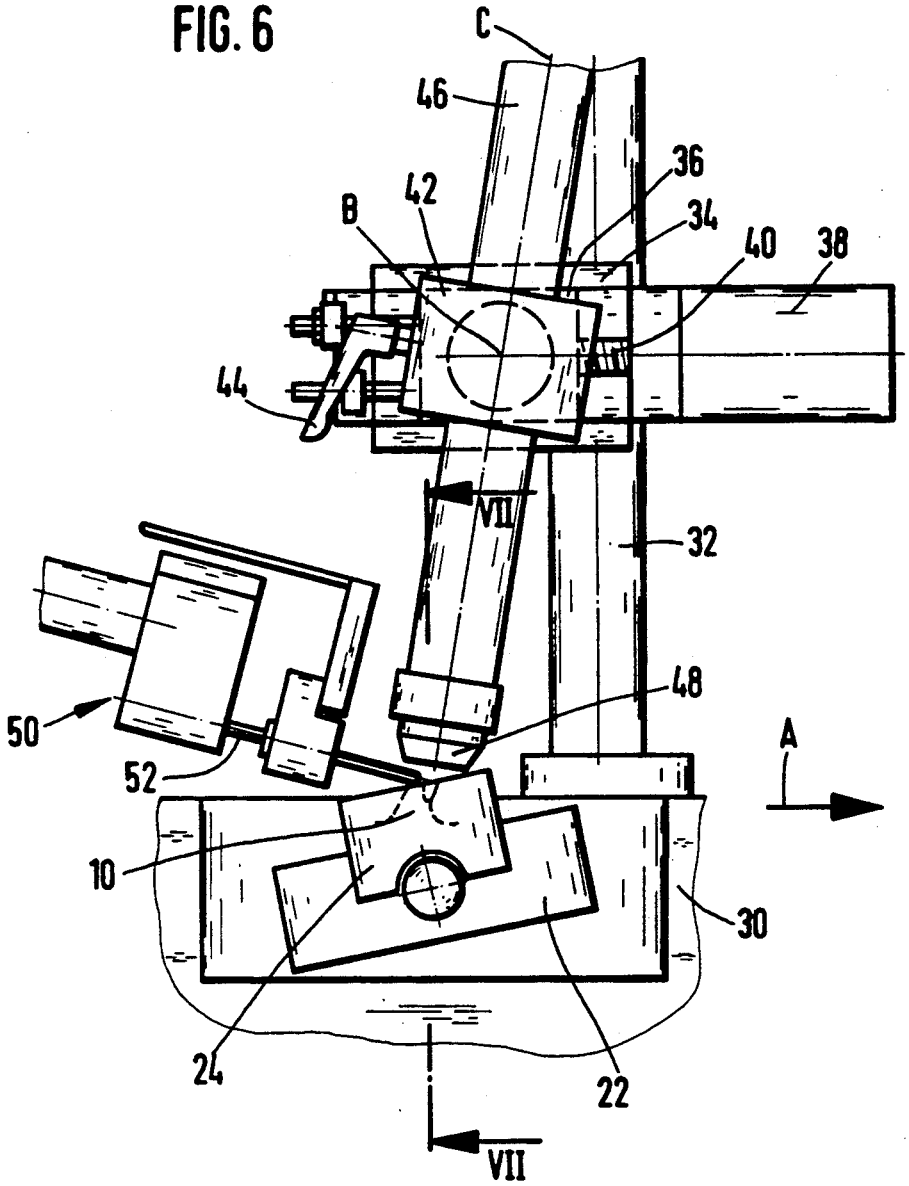
FIG. 6 is a side elevation of a first embodiment of such an apparatus constituting one form of the invention.
Figure 7:
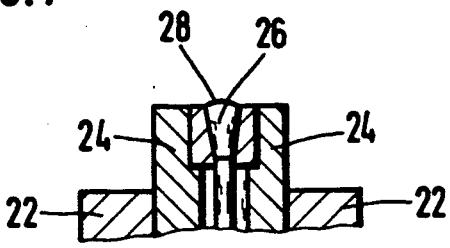
FIG. 7 shows a partial section along section line VII—VII in FIG. 6.

In the embodiment according to FIG. 6 the carriage 36 together with the plasma torch 46 is moved forwardly by means of the drive 38, to the right in FIG. 6, as soon as the mold cavity 26 is filled with molten hard material 20. As a result, the dome 28 is deformed so that the molten material 20 contained therein collects mainly at the tooth tip 18 and the surface thereof extends substantially flat and parallel to the back 14. As an alternative to the forward movement of the entire plasma torch 46, it suffices for the mouth 48 to be advanced by turning the rotary body 42 about the axis B.

Figure 8:
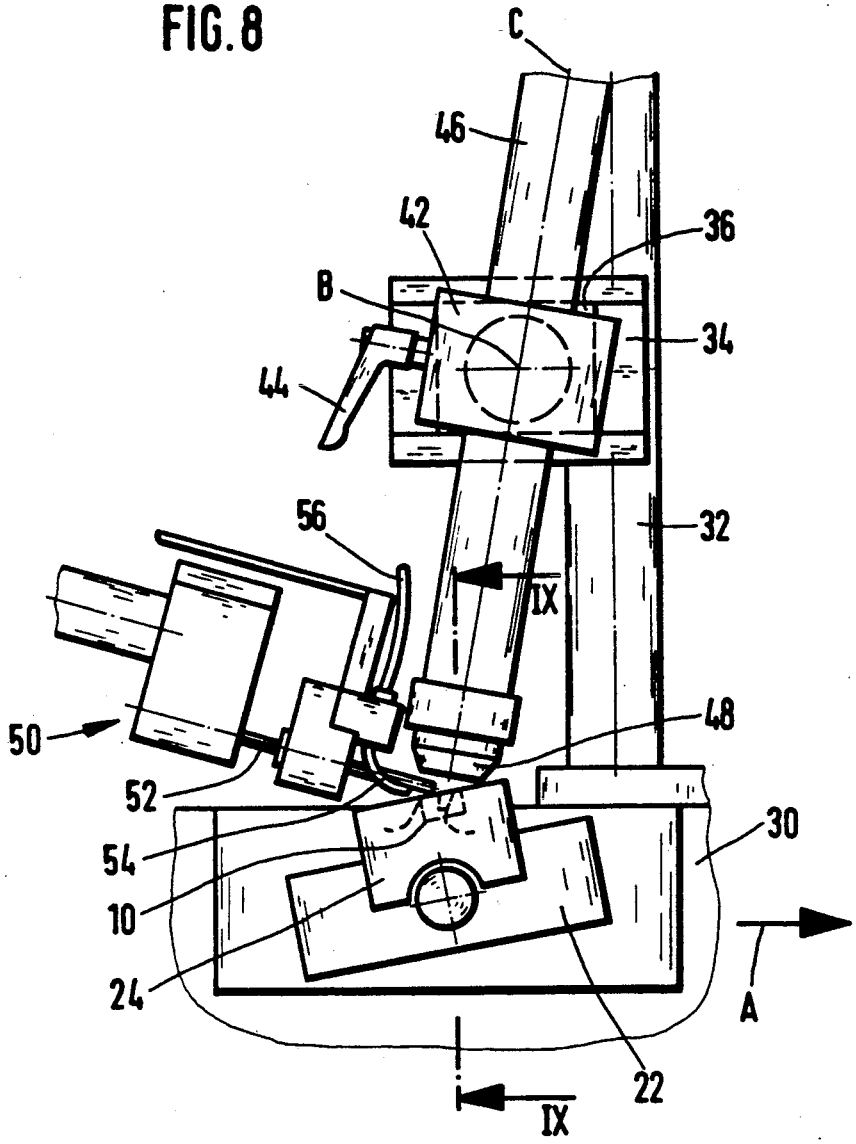
FIG. 8 is a side elevation of a modification of an apparatus like that shown in to FIG. 6.
Figure 9:
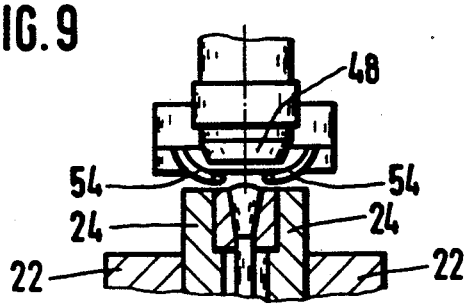
FIG. 9 shows a partial section along section lines IX—IX in FIG. 8.

In the embodiment illustrated in FIG. 8, on the feed means 50 a pair of nozzles 54 is disposed which are fed via conduits 56 with a protective or blanket gas, for example argon. As soon as the molten material fills the mold cavity 26 and has formed the dome 28 the latter is blasted by the protective gas emerging from the nozzles 54 in such a manner that it is deformed in the direction towards the tooth tip 18 and is again given a substantially planar surface parallel to the tooth back 14. While this is done the plasma torch 46 is switched off and/or moved along its axis C or by adjusting the guide 34 along the column 32 upwardly so that the hard material 20 solidifies.

Figure 10:
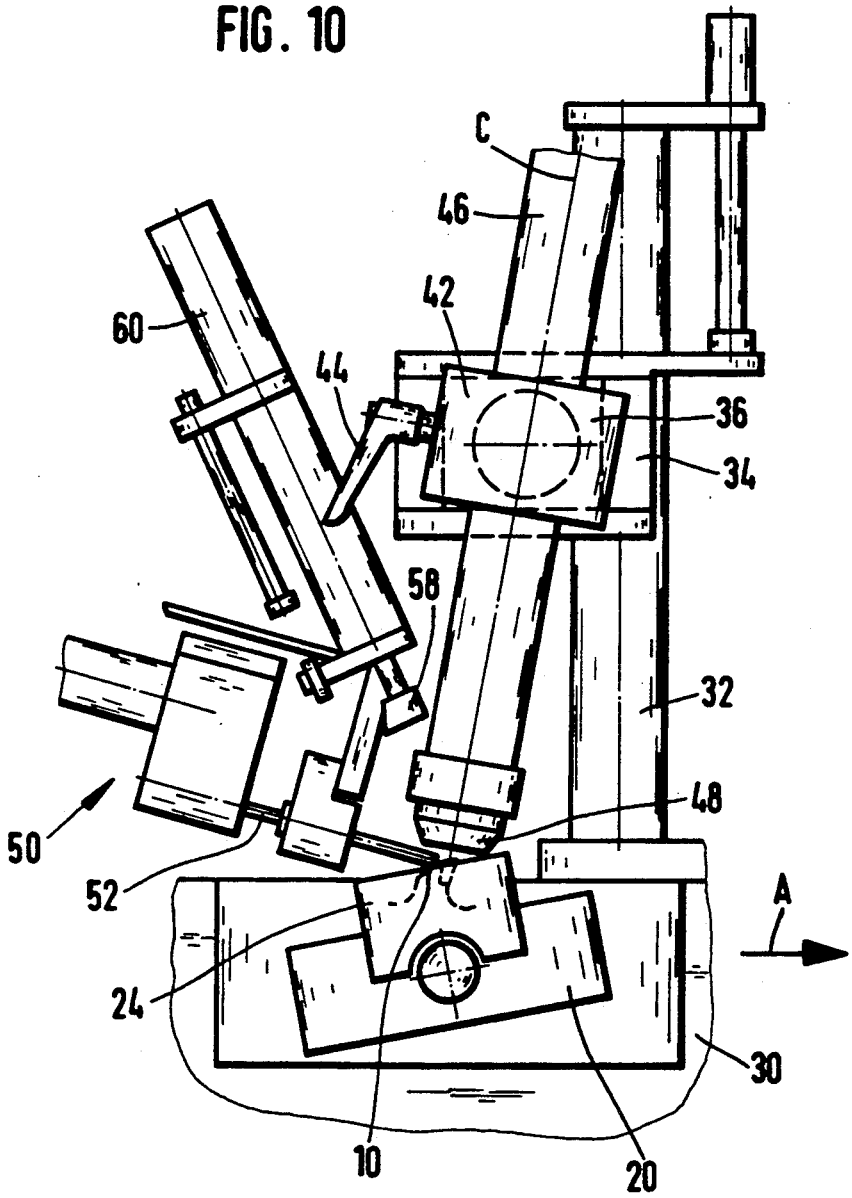
FIG. 10 is a side elevation of a third embodiment of the invention.

In the embodiment illustrated in FIG. 10 for flattening the dome 28 a ram 58 is provided which is adapted to be moved up and down along a ram axis D by means of a piston-cylinder unit 60. The ram axis D is inclined in the plane of the saw blade rearwardly in such a manner that it encloses with the cutting direction A an acute angle of at the most 70°, preferably about 55°. If the ram 58 is lowered onto the dome 28 formed by the molten material 20 said dome is deformed upwardly towards the tooth tip 18.

The steps described can be combined with each other. Thus, it is possible following a deformation of the dome 28 which has been effected by forward movement of the mouth 48 of the plasma torch 46 and/or by protective gas issued from the nozzles 54 or has at least been initiated thereby, to cause the punch 58 to act on the molten material 20 to give the latter the final form.

I claim:

1. In an apparatus for applying a hard surface coating to portions of cutting teeth, each tooth having a pair of flank regions, a face region, and a back region joining said face region at a tooth tip, said apparatus including mold means having a cavity configured to surround the tip region of a saw tooth and to confine portions of said flank regions and said face and back regions, said mold means having an opening extending outward from said cavity for admitting a mass of hardening material thereinto; means for providing a heated molten mass of said hardening material in said cavity, the mass thereafter hardening from the molten state when allowed to cool, the improvement comprising:

gas stream directing means for directing at least one gas stream to chosen regions of the upper surface of said molten mass to flatten the contour of said mass to cause it to more closely conform to the contour of said back region and move it along said tooth towards said tip, said material solidifying so conformed over said tooth and tip when it cools; and a torch separate from said gas stream directing means and having a mouth directed onto the tooth back to melt said hardening material.

* * * * *